US010609497B2

(12) United States Patent
Ochsenbein

(10) Patent No.: US 10,609,497 B2
(45) Date of Patent: Mar. 31, 2020

(54) CANAL HEARING DEVICE WITH RETAINER

(71) Applicant: Sonova AG, Stäfa (CH)

(72) Inventor: André L. Ochsenbein, Wolfhausen (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/043,221

(22) Filed: Jul. 24, 2018

(65) Prior Publication Data

US 2020/0037088 A1 Jan. 30, 2020

(51) Int. Cl.
*H04R 25/00* (2006.01)
*H04R 1/10* (2006.01)

(52) U.S. Cl.
CPC ..... *H04R 25/652* (2013.01); *H04R 1/105* (2013.01); *H04R 1/1066* (2013.01); *H04R 25/60* (2013.01); *H04R 2225/025* (2013.01)

(58) Field of Classification Search
CPC .... H04R 25/652; H04R 1/105; H04R 1/1066; H04R 25/60; H04R 2225/025; H04R 1/1016
See application file for complete search history.

(56) References Cited

U.S. PATENT DOCUMENTS 8,908,895 B2 12/2014 Wurfel
2009/0290739 A1* 11/2009 Edwards ..... H04R 25/305 381/328
2015/0271611 A1 9/2015 Higgins et al.
2016/0301999 A1* 10/2016 Lott ..... H04R 1/1016
2016/0309250 A1* 10/2016 Kelly ..... H04R 1/105

FOREIGN PATENT DOCUMENTS

DE 102 27 450 B4 1/2004

* cited by examiner

*Primary Examiner* — Sunita Joshi
(74) *Attorney, Agent, or Firm* — Henricks Slavin LLP

(57) ABSTRACT

A hearing device in accordance with at least one of the present inventions includes a receiver assembly and a retainer assembly, including an anchor and a flexible retainer strip extending from the anchor, configured to be mounted onto the receiver assembly in a predetermined orientation relative to the receiver assembly. The receiver assembly and the retainer assembly include respective elements that cooperate with one another to provide a visible and/or tactile indication that the anchor is in the predetermined orientation when the anchor is in the predetermined orientation and that the anchor is not in predetermined orientation when the anchor is in an orientation other than the predetermined orientation.

16 Claims, 6 Drawing Sheets

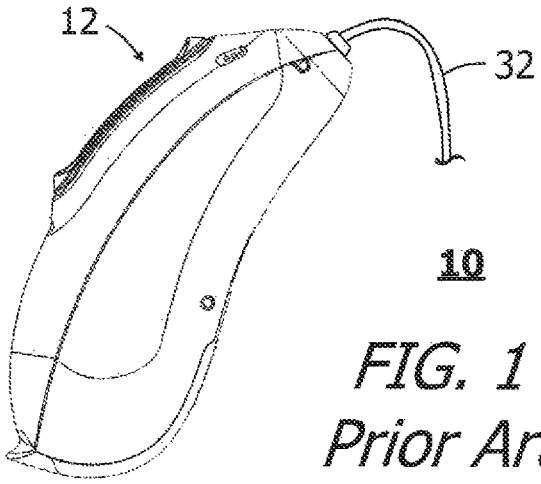
FIG. 1
Prior Art
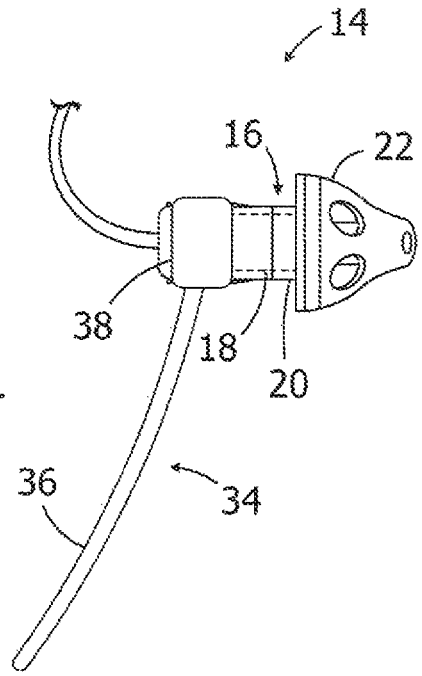
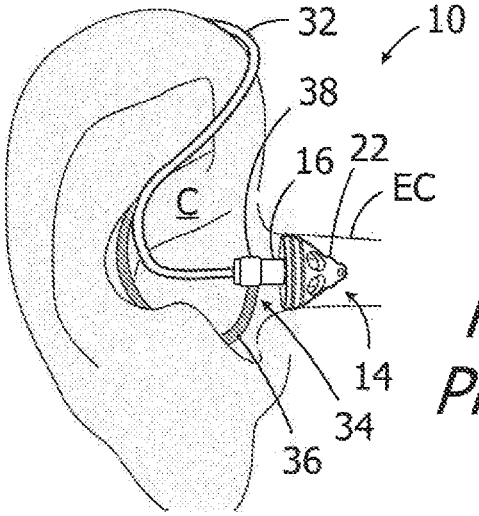
FIG. 2
Prior Art
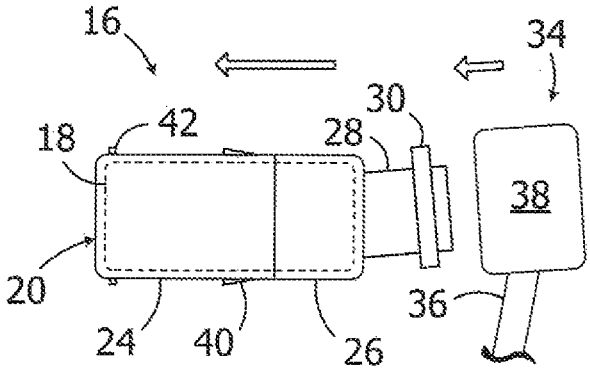
FIG. 3 - Prior Art
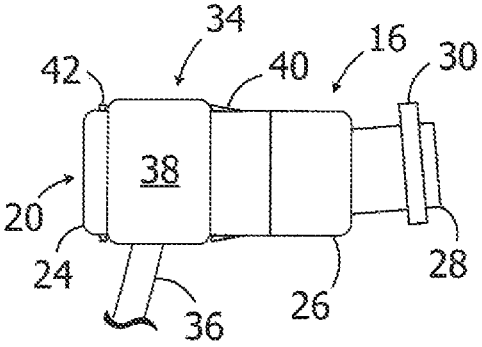
FIG. 4 - Prior Art

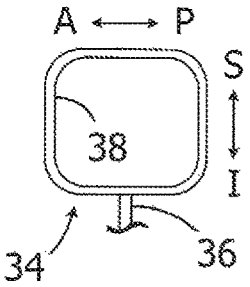
FIG. 5A
Prior Art
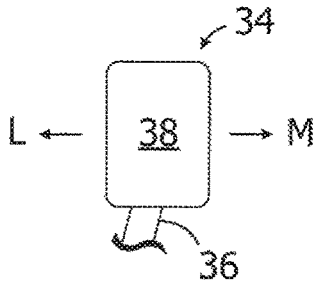
FIG. 5B
Prior Art
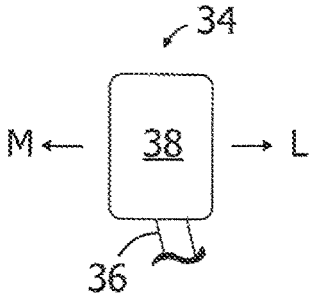
FIG. 5C
Prior Art
FIG. 6
Prior Art
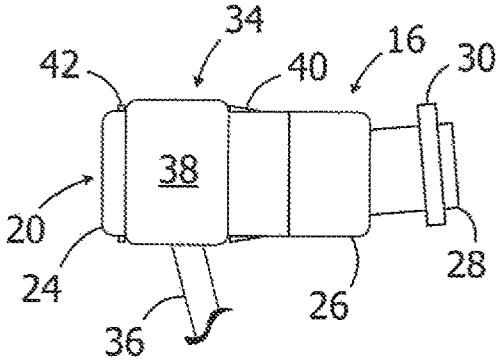
FIG. 7
Prior Art
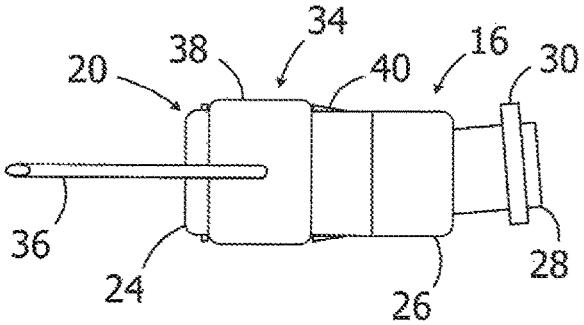
FIG. 8
Prior Art
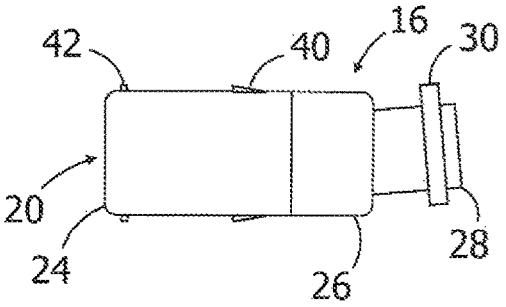

CANAL HEARING DEVICE WITH RETAINER

BACKGROUND

1. Field

The present inventions relate generally to hearing devices and, for example, hearing devices that include a component that is worn in the ear canal.

2. Description of the Related Art

As illustrated in FIGS. 1-4, one example of a conventional hearing system, which is generally identified by reference numeral 10, includes a behind-the-ear (BTE) component 12, with one or more microphones, a sound processor, a power source and other conventional instrumentalities, and an in-the-ear (ITE) component 14 that delivers sound to ear canal. The exemplary ITE component 14 includes a receiver assembly 16, with a receiver 18 and a receiver housing 20, and a soft earpiece 22 that is mounted on the medial end of the receiver assembly 16 to center the receiver relative to the ear canal. The receiver housing 20 has base 24, a cover 26, a sound tube 28, and an earpiece connector 30. A cable 32, which has connectors (not shown) on each end, electrically connects the BTE component 12 to the ITE component 14.

There are instances where a particular ITE component does not properly self-retain within a particular ear canal. As such, many hearing systems include retainers that hold the ITE component in the desired position. Additionally, because the retainer is not always needed, many retainers are provided as a separate component that may be attached to the associated ITE component if necessary. To that end, the exemplary hearing system 10 includes a retainer assembly 34 that applies inward force (i.e., force in the medial direction) to the ITE component 14. The retainer assembly 34 consists of a flexible retainer strip 36 and anchor 38 that slides over and onto the receiver housing 20 in the manner illustrated in FIGS. 3 and 4. The receiver housing 20 has tapered hooks 40, over which the anchor 38 slides after passing over sound tube 30 and part of the receiver housing, and abutments 42, which prevent the anchor from moving past the medial end of the receiver housing. The correct connection of the retainer assembly 34 to the ITE component 14 results in the retainer strip extending in a generally lateral/inferior direction prior to bending. During use, the ITE component 14 is positioned within the ear canal EC and the strip retainer strip 36 is bent into a stressed state and positioned within the concha C of the associated ear, as shown in FIG. 2.

Although useful, the present inventor has determined that conventional retainer assemblies are susceptible to improvement. By way of example, but not limitation, receiver assemblies and retainer assemblies are extremely small and have configurations that lend themselves to incorrect orientations during the process of mounting a retainer assembly onto a receiver assembly. In particular, as illustrated in FIG. 5A-5C, the anchor 38 includes four walls, the length of the four walls (medial-lateral direction) is the same (FIGS. 5B and 5C), the widths of the walls that face one another in the anterior-posterior direction are the same (FIG. 5A), and the widths of the walls that face one another in the superior-inferior direction are the same (FIG. 5A). In other words, the anchor 38 is symmetric (or at least substantially symmetric) which, given its small size, makes it difficult for the user to determine the correct orientation for the anchor when attaching the retainer assembly 34 to the receiver assembly 16.

The retainer assembly 34 may, for example, be incorrectly mounted onto the receiver assembly 16 in such a manner that the retainer strip 36 extends in a generally medial/inferior direction (FIG. 6) or in such a manner that the retainer strip 36 extends in the anterior or posterior direction (FIG. 7). Another issue is associated with the fact that the hooks 40 and abutments 42 have sharp corners, which can lead to irritation within the ear canal when the retainer assembly 34 is not used (FIG. 8). Another hearing system, which includes a retainer strip that in inserted through a slot during assembly, is illustrated in U.S. Pat. No. 8,908,895. Here too, the present inventor has determined that the manner in which the retainer strip is attached to the receiver assembly lends itself to incorrect orientations of the retainer strip.

SUMMARY

A hearing device in accordance with at least one of the present inventions includes a receiver assembly and a retainer assembly, including an anchor and a flexible retainer strip extending from the anchor, configured to be mounted onto the receiver assembly in a predetermined orientation relative to the receiver assembly. The receiver assembly and the retainer assembly include respective elements that cooperate with one another to provide a visible and/or tactile indication that the anchor is in the predetermined orientation when the anchor is in the predetermined orientation and that the anchor is not in predetermined orientation when the anchor is in an orientation other than the predetermined orientation. The present inventions also include hearing systems with such a hearing device and a sound processor.

There are a number of advantages associated with such a hearing devices and systems. By way of example, but not limitation, providing a visible and/or tactile indication that the anchor is in the predetermined orientation relative to the receiver assembly reduces the likelihood that the user will incorrectly mount the retainer assembly onto the receiver assembly.

The many features of the present inventions will become apparent as the inventions become better understood by reference to the following detailed description when considered in conjunction with the accompanying drawings.

BRIEF DESCRIPTION OF THE DRAWINGS

Detailed descriptions of the exemplary embodiments will be made with reference to the accompanying drawings.

FIG. 1 is a side view of a conventional hearing system.

FIG. 2 is a side view showing the hearing system illustrated in FIG. 1 within an ear.

FIGS. 3 and 4 are side views showing a portion of the hearing system illustrated in FIG. 1 being assembled.

FIGS. 5A-5C are end, side and opposite side views, respectively, of a portion of the hearing system illustrated in FIG. 1.

FIGS. 6 and 7 are side views showing a portion of the hearing system illustrated in FIG. 1 in incorrectly assembled states.

FIG. 8 is a side view of a portion of the hearing system illustrated in FIG. 1.

DETAILED DESCRIPTION OF EXEMPLARY EMBODIMENTS

The following is a detailed description of the best presently known modes of carrying out the inventions. This description is not to be taken in a limiting sense, but is made merely for the purpose of illustrating the general principles of the inventions.

Figure 9:
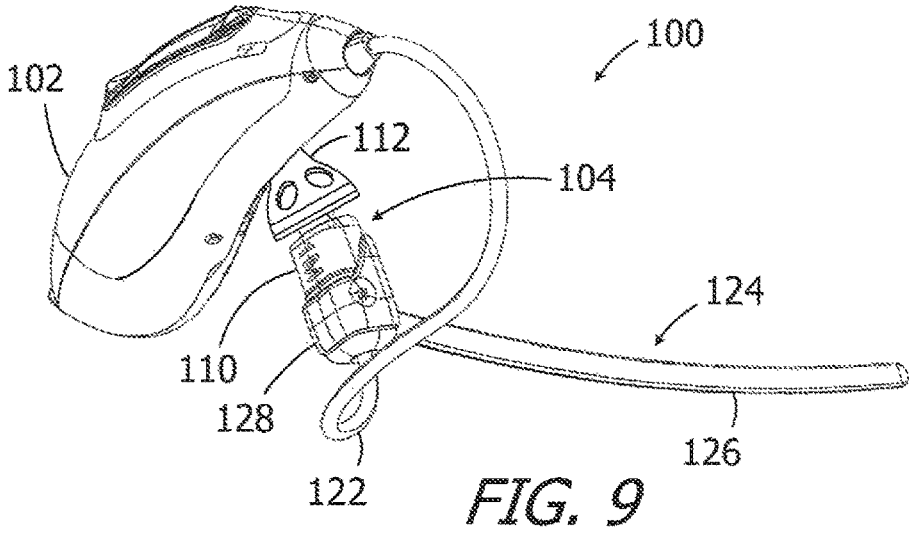
FIG. 9 is a perspective view of a hearing system in accordance with one embodiment of a present invention.
Figure 10:
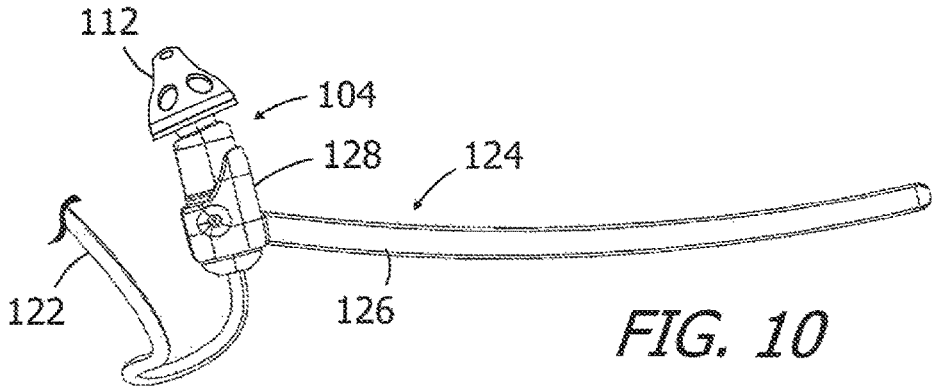
FIG. 10 is a side view of a portion of the hearing system illustrated in FIG. 9.
Figure 11:
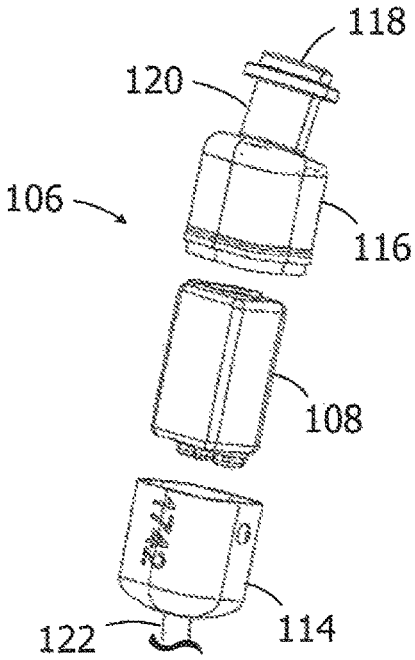
FIG. 11 is an exploded perspective view of a portion of the hearing system illustrated in FIG. 9.

As illustrated in FIGS. 9-11, a hearing system 100 in accordance with one embodiment of a present invention includes a behind-the-ear (BTE) component 102, with one or more microphones, a sound processor, a power source and other conventional instrumentalities, and an in-the-ear (ITE) component 104 that delivers sound to ear canal. One example of a suitable BTE component is the CROS B BTE component from Phonak. The exemplary ITE component 104 includes a receiver assembly 106, with a receiver 108 and a receiver housing 110, and a soft earpiece 112 that is mounted on the medial end of the receiver assembly 106 to center the receiver relative to the ear canal. The receiver housing 110 has base 114, a cover 116, a sound tube 118, and an earpiece connector 120. A cable 122, which has connectors (not shown) on each end, electrically connects the BTE component 102 to the ITE component 104. The exemplary hearing system 100 also includes a retainer assembly 124 that applies inward force (i.e., force in the medial direction) to the ITE component 104. The retainer assembly 124 consists of a flexible retainer strip 126 and an anchor 128, which defines an overall length in the medial lateral direction, that slides over and is mounted onto the receiver housing 110. This process may also be described as inserting the receiver assembly 106 into the anchor 128. The flexible retainer strip 126 extends from the anchor 128 and may be integral with (or simply attached to) the anchor 128. The retainer strip 126 is bent and positioned within the concha during use, in the manner described above with reference to FIG. 2, to retain the ITE component 104 within the ear canal.

Figure 12:
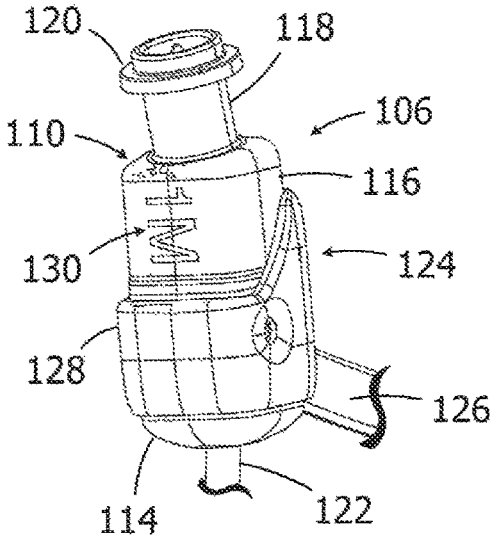
FIG. 12 is a perspective view of a portion of the hearing system illustrated in FIG. 9.

As discussed in greater detail below, the respective configurations of the ITE component 104 and the retainer assembly 124 reduce the likelihood that the user will mount the retainer assembly onto the ITE component in an incorrect orientation relative to the ITE component. For example, one side of the receiver assembly 106 may be provided with indicia 130 (FIG. 12) and the anchor may be configured in such a manner that the indicia will only be visible (or in some instances will only be entirely visible) when the retainer assembly 124 is correctly oriented relative to receiver assembly 106, as it is in FIGS. 9, 10 and 12. Alternatively, or in addition, the ITE component 104 and the retainer assembly 124 may include respective connectors that only mate with one another when the retainer assembly 124 is correctly oriented relative to receiver assembly 106.

Figure 13:
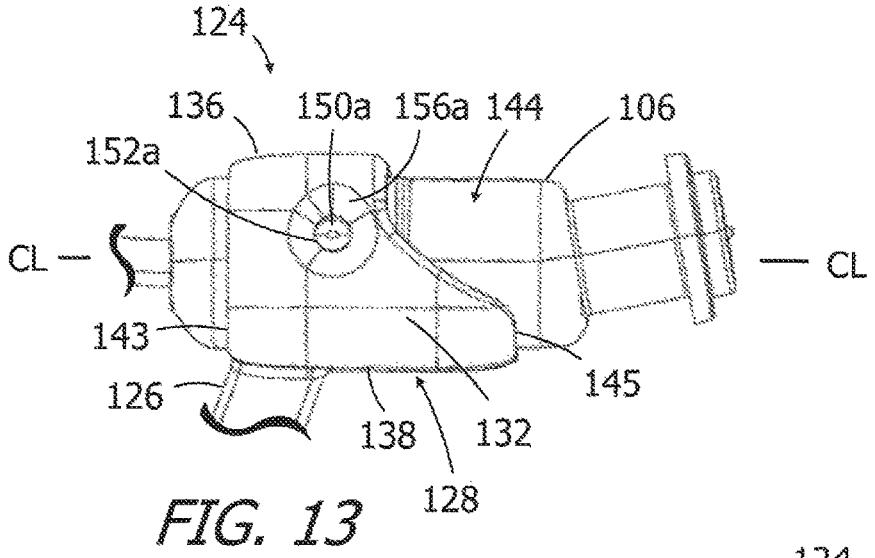
FIG. 13 is a side view of a portion of the hearing system illustrated in FIG. 9.
Figure 14:
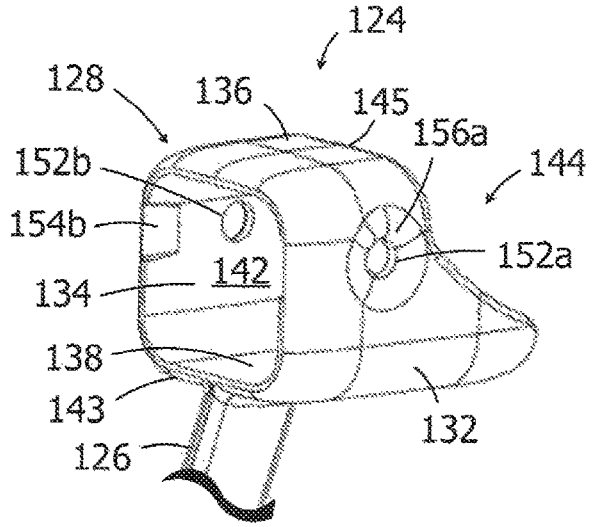
FIG. 14 is a perspective view of a portion of the hearing system illustrated in FIG. 9.
Figure 15:
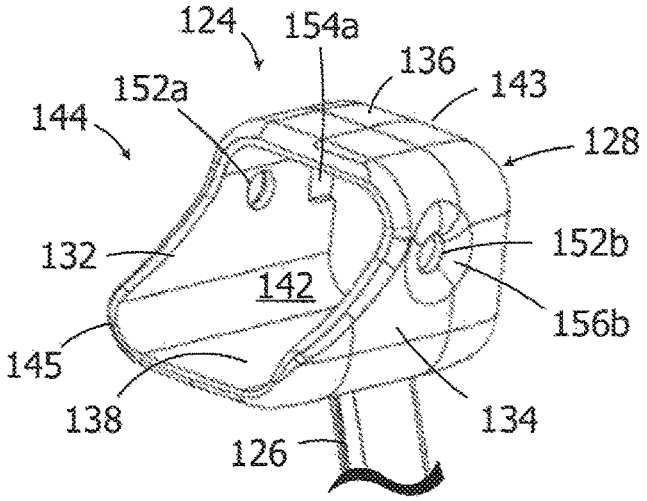
FIG. 15 is a perspective view of a portion of the hearing system illustrated in FIG. 9.

Turning to FIGS. 13-15, the exemplary anchor 128 may include a plurality of walls that define a receiver receiving region. In the illustrated embodiment, the exemplary anchor 128 includes anterior and posterior walls 132 and 134 as well as superior and inferior walls 136 and 138 that together define a receiver receiving region 142 that extends in the medial-lateral direction from medial ends 143 of the walls to the lateral ends 145 of the walls. The walls 132-138 include respective ends that form curved corners with adjacent walls. It should be noted here that the directional references presume that the wearer is standing and facing forward, and that the anterior and posterior designations depend upon which ear the hearing device is located.

The configuration of the walls 132-138 of the exemplary anchor 128 results in an anchor shape that is asymmetric. For example, two walls that face one another across the receiver receiving region 142 may be different lengths. In the illustrated implementation, the superior and inferior walls 136 and 138 are different lengths (in the medial-lateral direction), with the superior wall 136 being shorter than the inferior wall 138. The overall length of the anchor 128 is equal to the length of the inferior wall 138 in the illustrated implementation. In other implementations, the superior wall 136 may be longer than the inferior wall 138, or one of the anterior and posterior walls 132 and 134 may be longer than the other. The walls 132-138 may also be configured such that there is asymmetry at the corners. In any event, the asymmetry creates an aperture on one side of the receiver receiving region 142 and no aperture on the opposite side of the receiver receiving region due to the presence of a portion of a wall. The receiver receiving region 142 is visible from a direction perpendicular to the medial-lateral direction by way of the aperture 144. In the illustrated implementation there is an aperture 144 on one side of the receiver receiving region 142 and no aperture on the opposite side of the receiver receiving region due to the presence of a portion of the wall 138. Due to the presence of the aperture 144 on one side of the receiver receiving region 142, and the presence of a portion of the wall 138 on the opposite side, the exemplary anchor 128 will expose one side of the receiver assembly 106 and cover the opposite side, as shown in FIG. 13. In the illustrated implementation, the aperture 144 also extends to two other sides, whereby the receiver receiving region 142 is visible from three sides, and is blocked from view by a wall on the fourth side. The wall 138 extends the full length of the anchor 128 in the medial-lateral direction, while the walls 132-136 (or at least portions thereof) do not extend the full length of the anchor. Put another way, the aperture is a wall-free space on a portion of the perimeter of the receiver receiving region 142. In other implementations, for example, the entirety of the walls 132 and 134 may be full length, so that the receiver receiving region 142 is only visible from one side.

As illustrated in FIGS. 16-19, the exemplary receiver assembly 106 is configured to cooperate with the aperture 144 in such a manner that the user is provided with a visible and/or tactile indication as to whether or not a receiver assembly that has been inserted into the anchor (or that has been partially inserted, or that is about to be inserted) is correctly oriented relative to the anchor 128 and, accordingly, to the retainer assembly 124. For example, the exemplary receiver assembly 106 includes an indicia region 146 on one side thereof with, e.g., alphanumeric indicia 130 such as "1M" and/or a particular color and/or a bump or other tactile indicia, on the housing 110. The receiver assembly 106 also includes a region 148 with no indicia on the opposite side of the receiver assembly. The regions 146 and 148 must be located on the receiver in such a manner that they will be aligned with the aperture 144 when the receiver is fully inserted into the anchor. The receiver may, in some instances, also include other indicia (e.g., numerals "1742" in FIG. 17) that will not be visible regardless of receiver orientation relative to the anchor due to its location.

Figure 16:
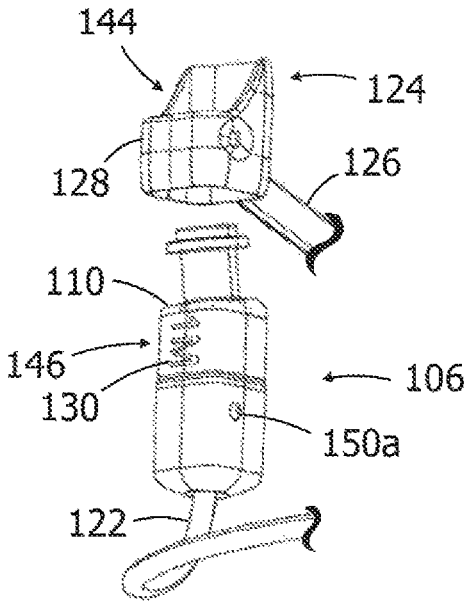
FIG. 16 is an exploded perspective view of a portion of the hearing system illustrated in FIG. 9.
Figure 18:
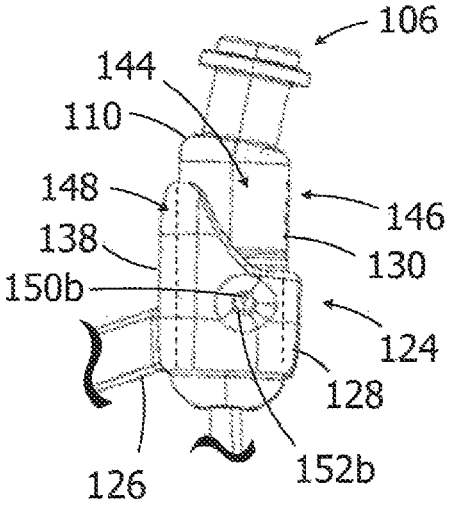
FIG. 18 is a side view of a portion of the hearing system illustrated in FIG. 9.
Figure 19:
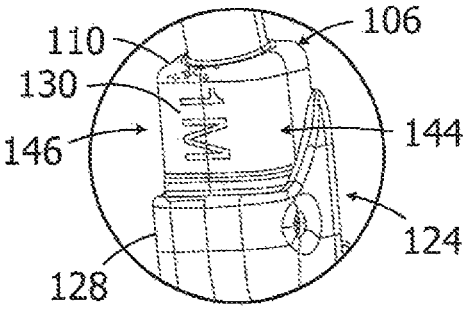
FIG. 19 is a perspective view of a portion of the hearing system illustrated in FIG. 9.

Referring more specifically to FIG. 16, even though the receiver assembly 106 and anchor 128 are very small, some users may be able to determine their relative orientation prior to insertion of the receiver assembly into the anchor by determining whether or not the indicia 130 and aperture 144 are facing in the same direction, as they are in FIG. 16, which is indicative of correct orientation. Once the insertion of the receiver assembly 106 into the anchor 128 is complete, the user will be able to observe the indicia region 146 (as well as the indicia 130) by way of the aperture 144, while the "no indicia" region 148 is blocked from view by a portion of the anchor (i.e., a portion of the wall 138 in the illustrated embodiment), as shown in FIGS. 18 and 19. This is indicative of correct orientation. If, on the other hand, the indicia region 146 (as well as the indicia 130) cannot be observed because it is covered by a portion of the anchor 128 (i.e., a portion of the wall 138 in the illustrated embodiment), the user will determine that the orientation is incorrect.

Alternatively, or in addition to the use of above-described indicia region, no indicia region and aperture, the present receiver assembly and anchor may include respective connectors that will secure the receiver assembly to the anchor when the receiver assembly is inserted into the anchor in the correct orientation, and that will resist insertion and fail to connect when the receiver assembly is inserted into the anchor in an incorrect orientation. In other words, the connectors are configured to cooperate with one another in such a manner that the user is provided with a visible and/or tactile indication as to whether or not a receiver assembly that has been inserted into the anchor (or that has been partially inserted) is correctly oriented relative to the anchor and, accordingly, the retainer assembly.

Figure 17:
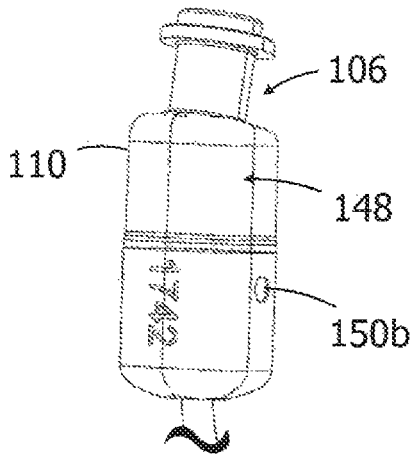
FIG. 17 is a perspective view of a portion of the hearing system illustrated in FIG. 9.

Referring first to FIGS. 16 and 17, the exemplary receiver assembly 106 includes receiver connectors, such as first and second protuberances 150*a* and 150*b* that extend outwardly from the outer surface of the housing 110. Turning to FIGS. 13-15, the exemplary anchor 128 includes anchor connectors, such as first and second protuberance receivers 152*a* and 152*b* in which the first and second protuberances 150*a* and 150*b*, respectively, will be located when the receiver is fully inserted into the anchor in the correct orientation, thereby latching the anchor and receiver to one another. The protuberance receivers 152*a* and 152*b* in the illustrated embodiment extend complete the through the walls 132 and 134, although indentations that extend partially through the walls may also be employed. It should also be noted that, in other implementations, the respective numbers of protuberances and protuberance receivers may be increased or decreased, the protuberances and protuberance receivers may be repositioned on the receiver and anchor, and/or the protuberances may be provided on the anchor and the protuberance receivers may be provided on the receiver. It should also be noted that the protuberances 150*a* and 150*b* may have a smooth, curved shape (such as the illustrated smooth elliptical shape) to prevent irritation of the ear canal when the retainer assembly 124 is not in use.

To facilitate insertion of the receiver assembly 106 into the anchor 128 despite the presence of the first and second protuberances 150*a* and 150*b*, the anchor may include ramps 154*a* and 154*b* on the inner surfaces of walls 132 and 134. The ramps 154*a* and 154*b* are respectively aligned with the protuberance receivers 152*a* and 152*b* in the medial-lateral direction. The distance between the walls 132 and 134 is greatest at the end of the ramps 154*a* and 154*b*, which provides additional clearance for the protuberances 150*a* and 150*b* as the receiver is inserted into the anchor 128. To facilitate removal of the receiver 106 from the anchor 128, if necessary, the outer surfaces of the walls 132 and 134 include indentations 156*a* and 156*b*. The indentations 156*a* and 156*b* will guide the end of a pen (or other small object) into the protuberance receivers 152*a* and 152*b* so that the first and second protuberances 150*a* and 150*b* can be pushed out of the protuberance receivers.

Figure 20:
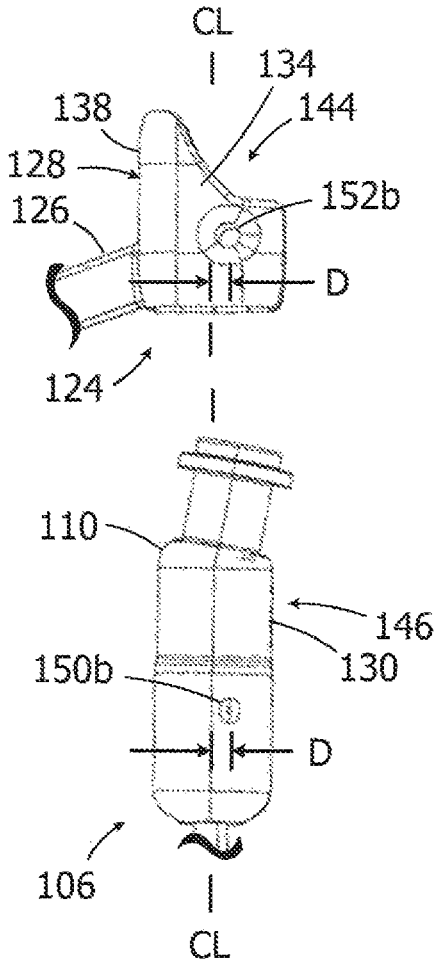
FIG. 20 is an exploded side view of a portion of the hearing system illustrated in FIG. 9 in a correctly oriented state.

Due to their respective locations, the protuberances 150*a* and 150*b* and protuberance receivers 152*a* and 152*b* also reduce the likelihood that the receiver assembly 106 will be inserted into the anchor 128 in an incorrect orientation. To that end, and referring to FIG. 20, the receiver assembly 106 and the anchor 128 each define a longitudinal centerline CL (in the medial-lateral direction) and the centerlines will be aligned with one another (as shown) when the receiver assembly 106 is within the anchor 128 (see also FIG. 13). The protuberances 150*a* and 150*b* and protuberance receivers 152*a* and 152*b* are each offset from the centerline CL by the same distance D (i.e., are asymmetrically located). The offset is in the same direction relative to the centerline CL when the receiver assembly 106 and the anchor 128 are in the correct orientation relative to one another, with the indicia region 146 within the aperture 144. As such, when the receiver assembly 106 is inserted into the anchor 128, the protuberances 150*a* and 150*b* will be respectively aligned with the protuberance receivers 152*a* and 152*b* (and ramps 154*a* and 154*b*) and will enter the protuberance receivers when the receiver assembly reaches its fully inserted position, as shown in FIGS. 13 and 18, thereby latching the receiver assembly and anchor to one another.

Figure 21:
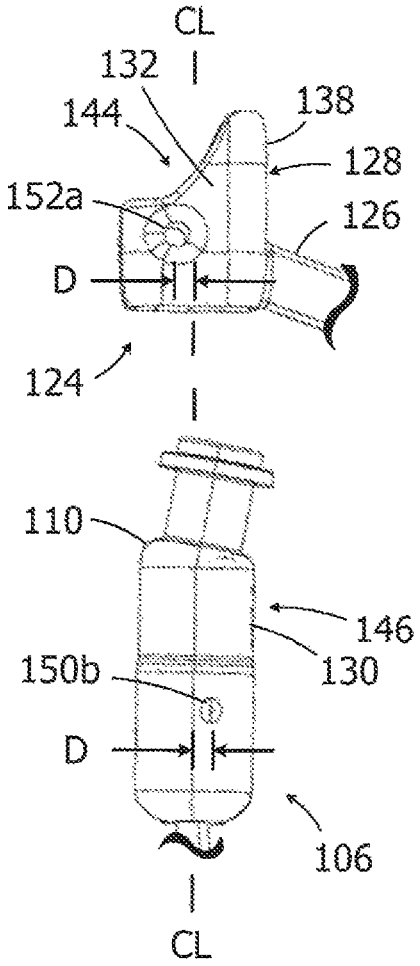
FIG. 21 is an exploded side view of a portion of the hearing system illustrated in FIG. 9 in an incorrectly oriented state.

Conversely, when the receiver assembly 106 and the anchor 128 are incorrectly oriented relative to one another as shown in FIG. 21, with the indicia region 146 facing the wall 138, the protuberances 150*a* and 150*b* are offset from the centerline CL (by distance D) in one direction, and the protuberance receivers 152*a* and 152*b* are offset from the centerline CL (by distance D) in a different direction. As a result, when receiver assembly 106 is being inserted into the anchor 128, the protuberances 150*a* and 150*b* will engage the end of the walls 132 and 134, instead of sliding up the ramps 154*a* and 154*b*, which will provide a tactile indication of incorrect orientation. Moreover, the protuberances 150*a* and 150*b* will not enter the protuberance receivers 152*a* and 152*b*, even when aligned in the medial-lateral direction, because they are offset from the centerline CL in opposite directions. The failure to latch provides another indication to the user that the receiver assembly 106 and the anchor 128 are incorrectly oriented relative to one another.

Although the inventions disclosed herein have been described in terms of the preferred embodiments above, numerous modifications and/or additions to the above-described preferred embodiments would be readily apparent to one skilled in the art. By way of example, but not limitation, although the exemplary protuberances 150*a* and 150*b* are slightly elliptical in shape and protuberance receivers 152*a* and 152*b* are circular in shape (FIG. 13), other shapes may be employed for each. For example, the protuberances and protuberance receivers may be the same shape and, whether the same or different, may be circles, polygons or other shapes. It should be noted, however, that a tight fit in the medial-lateral direction may be desirable in order to precisely position the anchor. The inventions include any combination of the elements from the various species and embodiments disclosed in the specification that are not already described. It is intended that the scope of the present inventions extend to all such modifications and/or additions and that the scope of the present inventions is limited solely by the claims set forth below.

I claim:

1. A hearing device, comprising:

a receiver assembly including indicia; and a retainer assembly, including an anchor and a flexible retainer strip extending from the anchor, configured to be mounted onto the receiver assembly in a correct orientation relative to the receiver assembly;

wherein the receiver assembly and the retainer assembly are configured to cooperate with one another in such a manner that the indicia is visible when the anchor is in the correct orientation and is not visible due to the presence of a portion of the retainer assembly when the anchor is in an orientation other than the correct orientation.

2. A hearing device as claimed in claim 1, wherein the anchor defines a length in a medial-lateral direction and a receiver receiving region that extends in the medial-lateral direction; and the anchor is asymmetric and the asymmetry creates an aperture through which the receiver receiving region is visible from a direction perpendicular to the medial-lateral direction.

3. A hearing device as claimed in claim 2, wherein the indicia is visible by way of the aperture when the anchor is mounted on the receiver assembly in the correct orientation; and the indicia is not visible when the anchor is mounted on the receiver assembly in an orientation other than the correct orientation.

4. A hearing device, comprising:

a receiver assembly that defines a centerline and includes a receiver connector that is offset from the centerline; and a retainer assembly, including an anchor and a flexible retainer strip extending from the anchor, configured to be mounted onto the receiver assembly in a correct orientation relative to the receiver assembly, the anchor defining a length in a medial-lateral direction, a centerline, and a receiver receiving region that extends in the medial-lateral direction, being asymmetric with an asymmetry that creates an aperture through which the receiver receiving region is visible from a direction perpendicular to the medial-lateral direction, and including an anchor connector that is offset from the centerline and configured to mate with the receiver connector;

wherein the receiver connector and the anchor connector will mate with one another and will provide a visible and/or tactile indication that the anchor is in the correct orientation when the anchor is mounted on the receiver assembly in the correct orientation; and wherein the receiver connector and the anchor connector will be offset from one another, will not mate with one another and will provide a visible and/or tactile indication that the anchor is not in the correct orientation when the anchor is mounted on the receiver assembly in an orientation other than the correct orientation.

5. A hearing device as claimed in claim 1, wherein the anchor defines a length in a medial-lateral direction and a receiver receiving region that extends in the medial-lateral direction;

the anchor includes first, second, third and fourth walls, the first and second walls facing one another across the receiver receiving region, and the third and fourth walls facing one another across the receiver receiving region;

the first and second walls define respective lengths in the medial-lateral direction; and the length of the second wall is less than the length of the first wall.

6. A hearing device as claimed in claim 5, wherein the length of the first wall is equal to the length of the anchor.

7. A hearing device as claimed in claim 5, wherein the anchor includes an aperture at the second wall through which the receiver receiving region is visible from a direction perpendicular to the medial-lateral direction.

8. A hearing device as claimed in claim 5, wherein the third and fourth walls include respective portions that define a length equal to the length of the anchor and respective portions that define a length that is less than the length of the anchor.

9. A hearing device as claimed in claim 5, wherein the indicia is visible adjacent to the second wall when the anchor is mounted on the receiver assembly in the correct orientation; and the indicia is covered by the first wall when the anchor is mounted on the receiver assembly in an orientation other than the correct orientation.

10. A hearing device, comprising:

a receiver assembly that defines a centerline and includes a connector that is offset from the centerline; and a retainer assembly, including an anchor and a flexible retainer strip extending from the anchor, configured to be mounted onto the receiver assembly in a correct orientation relative to the receiver assembly, the anchor defining a length in a medial-lateral direction, a centerline, and a receiver receiving region that extends in the medial-lateral direction, and including first, second, third and fourth walls, the first and second walls facing one another across the receiver receiving region, and the third and fourth walls facing one another across the receiver receiving region, the first and second walls defining respective lengths in the medial-lateral direction, the length of the second wall being less than the length of the first wall, and further including a connector that is offset from the centerline and configured to mate with the receiver connector;

wherein the receiver assembly and anchor connectors will mate with one another and will provide a visible and/or tactile indication that the anchor is in the correct orientation when the anchor is mounted on the receiver assembly in the correct orientation; and wherein the receiver assembly and anchor connectors will be offset from one another, will not mate with one another and will provide a visible and/or tactile indication that the anchor is not in the correct orientation when the anchor is mounted on the receiver assembly in an orientation other than the correct orientation.

11. A hearing device, comprising:

a receiver assembly; and a retainer assembly, including an anchor and a flexible retainer strip extending from the anchor, configured to be mounted onto the receiver assembly in a correct orientation relative to the receiver assembly;

wherein the receiver assembly and anchor include an asymmetric connector arrangement that will latch the anchor to the receiver assembly when the anchor is mounted on the receiver assembly in the correct orientation and will not latch the anchor to the receiver assembly when the anchor is mounted on the receiver assembly in an orientation other than the correct orientation, thereby providing a visible and/or tactile indication that the anchor is in the correct orientation when the anchor is in the correct orientation and that the anchor is not in correct orientation when the anchor is in an orientation other than the correct orientation.

12. A hearing device, comprising:

a receiver assembly that defines a centerline and includes a receiver connector that is offset from the centerline; and a retainer assembly, including an anchor and a flexible retainer strip extending from the anchor, configured to be mounted onto the receiver assembly in a correct orientation relative to the receiver assembly, the anchor defining a centerline and including an anchor connector that is offset from the centerline and configured to mate with the receiver connector;

wherein the receiver connector and the anchor connector will mate with one another and will provide a visible and/or tactile indication that the anchor is in the correct orientation when the anchor is mounted on the receiver assembly in the correct orientation; and wherein the receiver connector and anchor connector will be offset from one another, will not mate with one another and will provide a visible and/or tactile indication that the anchor is not in the correct orientation when the anchor is mounted on the receiver assembly in an orientation other than the correct orientation.

13. A hearing device as claimed in claim 12, wherein the receiver connector includes at least one protuberance; and the anchor connector includes at least one protuberance receiver.

14. A hearing device as claimed in claim 12, wherein the anchor includes a ramp that is aligned with the protuberance receiver.

15. A hearing device as claimed in claim 1, wherein the receiver assembly includes a receiver housing and a receiver located within the receiver housing.

16. A hearing system, comprising:

a hearing device as claimed in claim 1; and a behind-the-ear sound processor operably connected to the hearing device.

* * * * *